US005640169A

United States Patent [19]

Weaver

[11] Patent Number: 5,640,169

[45] Date of Patent: Jun. 17, 1997

[54] PROTECTED ANTENNA APPARATUS

[76] Inventor: James C. Weaver, 21224 Quesada Ave., Port Charlotte, Fla. 33952

[21] Appl. No.: 546,701

[22] Filed: Oct. 23, 1995

[51] Int. Cl.[6] ..... H01Q 1/42

[52] U.S. Cl. ..... 343/872; 343/825; 343/828

[58] Field of Search ..... 343/872, 873, 343/878, 883, 888, 900, 825, 715, 790, 791, 828; H01Q 1/42

[56] References Cited

U.S. PATENT DOCUMENTS

| | | | |
|---|---|---|---|
| 4,366,485 | 12/1982 | Hodgkinson | 343/791 |
| 4,644,364 | 2/1987 | Parks | 343/825 |
| 5,451,971 | 9/1995 | Grossman et al. | 343/825 |

*Primary Examiner*—Hoanganh T. Le

[57] ABSTRACT

A protected antenna apparatus including an elongated tube; a cable having an upper end with a pair of separate bare leads extending therefrom, a lower end with a connector secured thereto, and an intermediate portion extended between the ends; a twin-lead transmission line having a central axis, a free upper end, a lower end with the bare leads extending therefrom and interconnected together, an intermediate location therebetween wherein each lead is connected with one of the bare leads of the cable, and a notch formed on an upper extent of the line at a location between the intermediate location and the upper end to thereby divide one of the leads into two different pieces and thus create a J-pole antenna having a short leg, a long leg, and an impedance matching stub portion therebetween, and wherein the antenna transmits radio signals of a characteristic frequency as a function of the lengths of the legs and the stub portion; and a coupling mechanism for securing the antenna within the tube and along a longitudinal extent thereof.

13 Claims, 3 Drawing Sheets

PROTECTED ANTENNA APPARATUS

BACKGROUND OF THE INVENTION

1. Field of the Invention

The present invention relates to a protected antenna apparatus and more particularly pertains to transmitting radio signals at characteristic frequencies with a protected antenna apparatus.

2. Description of the Prior Art

The use of antenna devices is known in the prior art. More specifically, antenna devices heretofore devised and utilized for the purpose of transmitting radio frequencies at characteristic frequencies are known to consist basically of familiar, expected and obvious structural configurations, notwithstanding the myriad of designs encompassed by the crowded prior art which have been developed for the fulfillment of countless objectives and requirements.

By way of example, U.S. Pat. No. 4,366,485 to Hodgkinson discloses a concentric tube antenna encased in dielectric. U.S. Pat. No. 4,825,222 to Butcher discloses an omnidirectional antenna with hollow point source feed. U.S. Pat. No. 4,956,647 to Kiurara discloses a rod antenna. U.S. Pat. No. 5,220,338 to Matsushita discloses an antenna element. U.S. Pat. No. 5,258,772 to inanaga et al. discloses an antenna device.

While these devices fulfill their respective, particular objective and requirements, the aforementioned patents do not describe a protected antenna apparatus that is simple in design, can be constructed in an expedient manner, and provides a structure that protects the antenna against harsh use conditions.

In this respect, the protected antenna apparatus according to the present invention substantially departs from the conventional concepts and designs of the prior art, and in doing so provides an apparatus primarily developed for the purpose of transmitting radio signals at characteristic frequencies.

Therefore, it can be appreciated that there exists a continuing need for new and improved protected antenna apparatus which can be used for transmitting radio signals at characteristic frequencies. In this regard, the present invention substantially fulfills this need.

SUMMARY OF THE INVENTION

In the view of the foregoing disadvantages inherent in the known types of antenna devices now present in the prior art, the present invention provides an improved protected antenna apparatus. As such, the general purpose of the present invention, which will be described subsequently in greater detail, is to provide a new and improved protected antenna apparatus and method which has all the advantages of the prior art and none of the disadvantages.

To attain this, the present invention essentially comprises, in combination, a rigid plastic and T-shaped tubular coupler having an open upper end, an open lower end, a lateral and open intermediate end, and a rigid plastic bottom cap with a circular axial bore disposed thereon. The bottom cap is removably secured over the intermediate end of the coupler. A straight rigid elongated plastic tube of a circular cross-section is provided. The tube has a central axis, an open upper end, an open lower end, an exterior surface, and a smooth interior surface. The lower end of the tube is slidably removably secured within the upper end of the coupler. The upper end of the tube further has a rigid plastic top cap removably secured thereto and a hole formed therethrough at a location below the top cap.

A sheathed 50-ohm coaxial cable is included and has an upper end with a pair of separate bare leads extending therefrom, a lower end with a coaxial connector secured thereto, and an intermediate portion extended between the ends and through the bore of the bottom cap. A linear and generally flat ribbon-type twin-lead sheathed 300 ohm transmission line is also included and has a central axis, a free upper end with a central bore formed thereon between the leads, a lower end with the bare leads extending therefrom and interconnected together, an intermediate location therebetween wherein each lead is connected with one of the bare leads of the coaxial cable, and a notch formed on an upper extent of the line at a location between the intermediate location and the upper end. The notch thereby divides one of the leads into two different pieces, thus creating a J-pole antenna. The J-pole antenna has a short leg, a long leg, and an impedance matching stub portion therebetween. The stub portion has a characteristic axial length as defined with respect to the central axis of the transmission line. The antenna transmits radio signals as a function of the lengths of the legs and the stub portion.

A loop of line is included and disposed through the hole of the tube and the bore on the transmission line. The loop of line is used for coupling the antenna to the tube and for further allowing the tube to be hung from a recipient object. A telescopic pole formed of a plurality of longitudinally connected tubular sections is provided. The pole has a free lower end and an upper end that is removably secured with the lower end of the coupler. The pole is extendable and retractable for allowing the elevation of the antenna to be adjusted. Lastly, a coupling mechanism for securing the lower end of the pole to a recipient object is included.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved protected antenna apparatus which has all the advantages of the prior art antenna devices and none of the disadvantages.

It is another object of the present invention to provide a new and improved protected antenna apparatus which may be easily and efficiently manufactured and marketed.

It is a further object of the present invention to provide a new and improved protected antenna apparatus which is of durable and reliable construction.

An even further object of the present invention is to provide a new and improved protected antenna apparatus which is susceptible of a low cost of manufacture with regard to both materials and labor, and which accordingly is then susceptible of low prices of sale to the consuming public, thereby making such a protected antenna apparatus economically available to the buying public.

Still yet another object of the present invention is to provide a new and improved protected antenna apparatus which provides in the apparatuses and methods of the prior art some of the advantages thereof, while simultaneously overcoming some of the disadvantages normally associated therewith.

Even still another object of the present invention is to provide a new and improved protected antenna apparatus for transmitting radio signals at characteristic frequencies.

Lastly, it is an object of the present invention to provide a new and improved protected antenna apparatus comprising an elongated plastic tube; a sheathed cable having an upper end with a pair of separate bare leads extending therefrom, a lower end with a connector secured thereto, and an intermediate portion extended between the ends; a twin-lead transmission line having a central axis, a free upper end, a lower end with the bare leads extending therefrom and interconnected together, an intermediate location therebetween wherein each lead is connected with one of the bare leads of the cable, and a notch formed on an upper extent of the line at a location between the intermediate location and the upper end to thereby divide one of the leads into two different pieces, and thus create a J-pole antenna having a short leg, a long leg, and an impedance matching stub portion therebetween, wherein the stub portion has a characteristic axial length as defined with respect to the central axis of the transmission line, and wherein the antenna transmits radio signals of a characteristic frequency as a function of the lengths of the legs and the stub portion; and a coupling mechanism for securing the antenna along a longitudinal extent of the tube.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
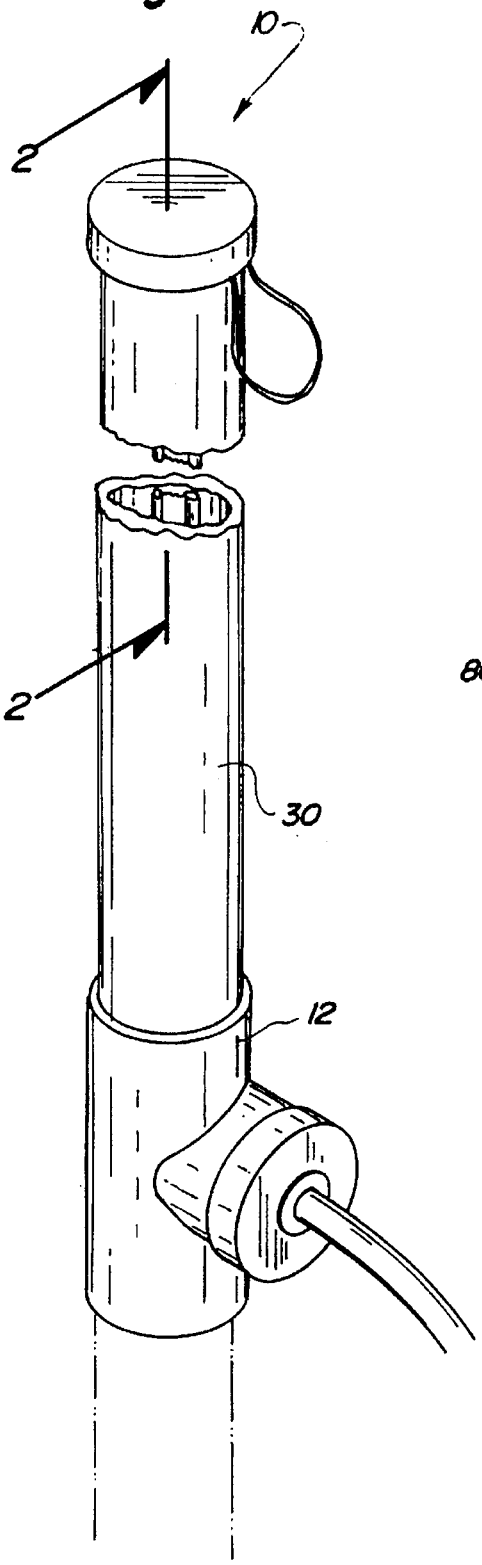
FIG. 1 is a perspective fragmentary view of the preferred embodiment constructed accordance with the principles of the present invention.
Figure 2:
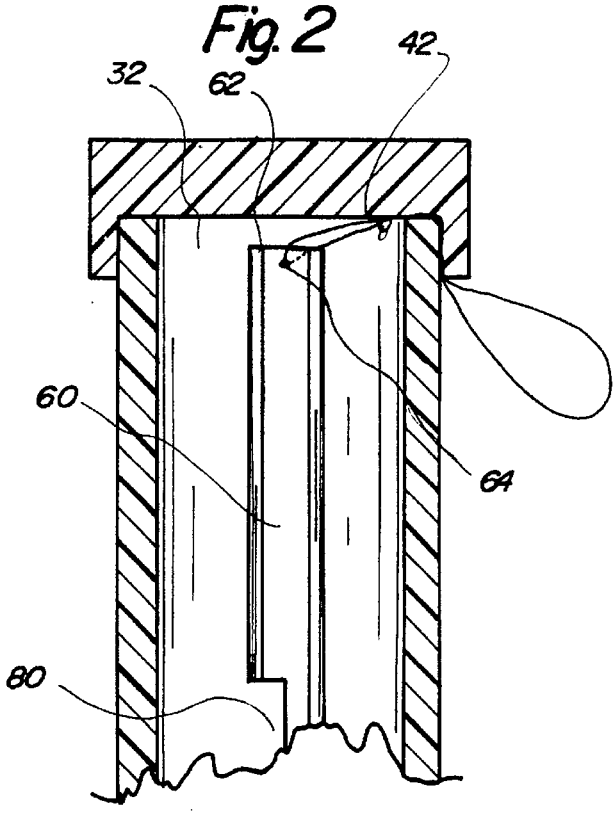
FIG. 2 is a cross-sectional view of the present invention taken along the line 2—2 of FIG. 1.
Figure 3:
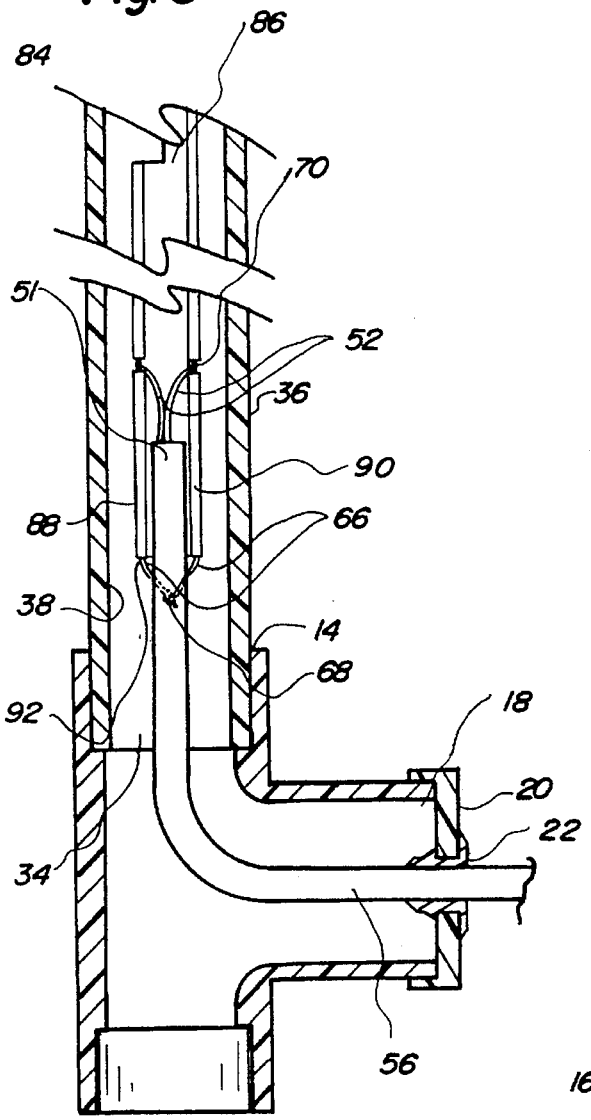
FIG. 3 is a cross-sectional view of a lower extent of the present invention.
Figure 4:
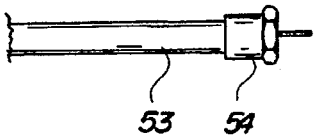
FIG. 4 is a side-elevational view of a F-type coaxial connector for securing the present invention to an external radio or other transmission device.
Figure 5:
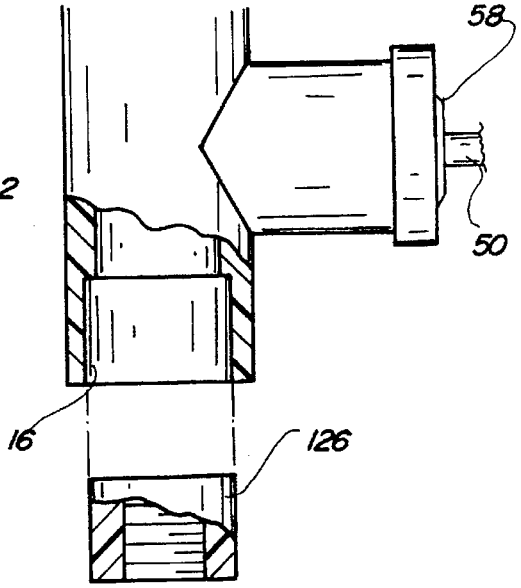
FIG. 5 is an exploded fragmentary view of a lower extent of the antenna and its securement to an additional mounting apparatus.
Figure 6:
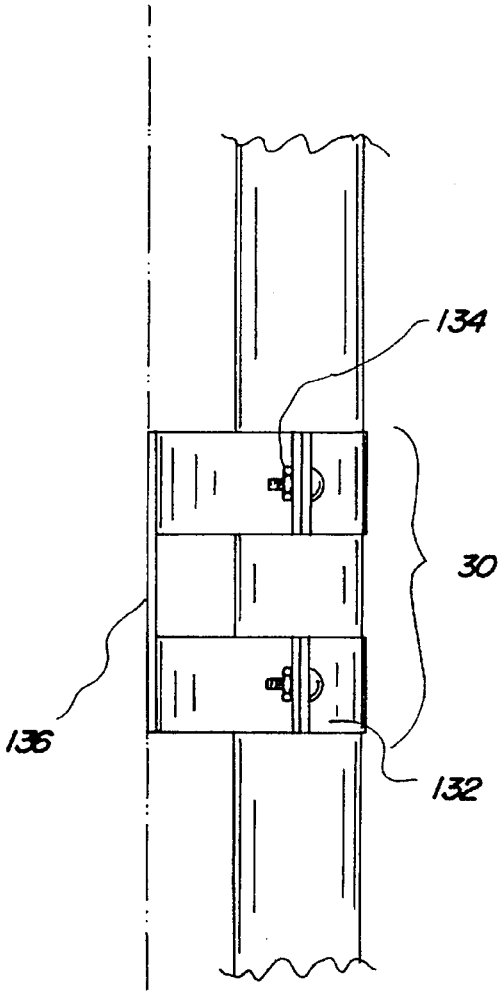
FIG. 6 is a side-elevational view of the brackets used for mounting the present invention to a recipient object such as a wall.
Figure 7:
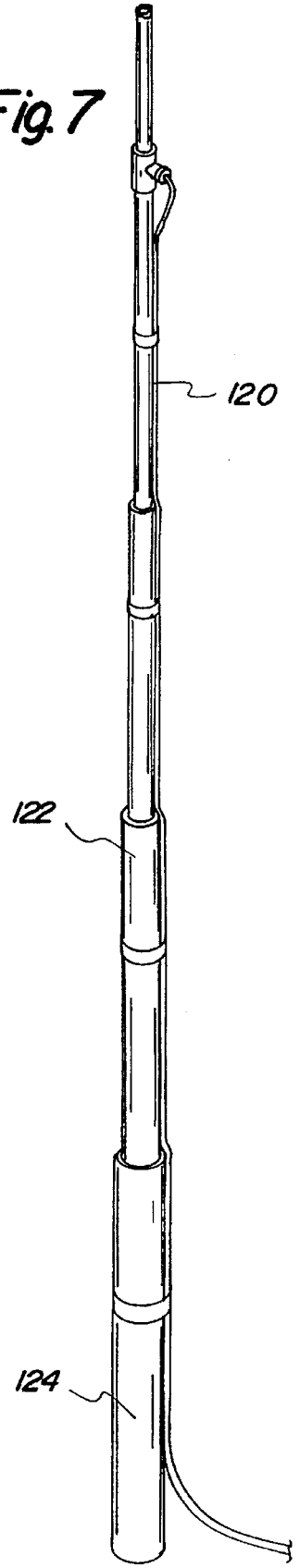
FIG. 7 is a perspective view of the tube and coupler secured to a telescopic pole, the pole being used for raising the antenna to a desired height.
Figure 8:
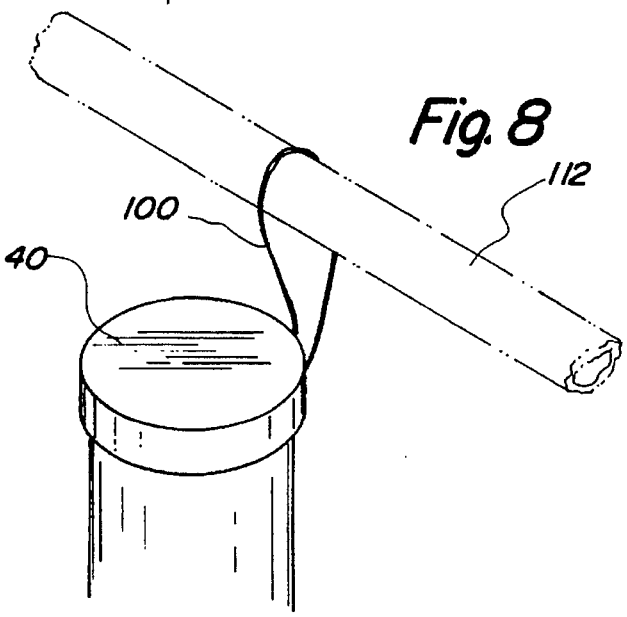
FIG. 8 is a perspective view of an upper portion of the present invention and its loop secured about a recipient object for hanging the present invention.

With reference now to the drawings, and in particular, to FIG. 1 thereof, the preferred embodiment of the new and improved protected antenna apparatus embodying the principles and concepts of the present invention and generally designated by the reference number 10 will be described.

The preferred embodiment of the present invention comprises a plurality of components. In their broadest context, such components include a coupler, tube, cable, transmission line, loop of line, pole, and coupling mechanism. Such components are individually configured and correlated with respect to each other to provide a structure that allows for transmitting radio signals at characteristic frequencies.

Specifically, the present invention includes a rigid and T-shaped coupler 12. The coupler is tubular and formed of plastic. The coupler has an open upper end 14, an open lower end 16, and a lateral facing and open intermediate end 18. The coupler also includes a rigid plastic bottom cap 20. The cap has a circular axial bore 22 disposed thereon. The bottom cap is removably secured over the intermediate end 18 of the coupler.

Also provided is a straight elongated tube 30. The tube has a circular cross-section and is formed of a rigid plastic. The tube has a central axis, an open upper end 32, and an open lower end 34. The tube has a smooth exterior surface 36 and a smooth interior surface 38. The lower end of the tube is slidably and removably secured within the upper end of the coupler 14. In the coupled position, the exterior surface 36 is positioned in facing contact with the coupler. A rigid plastic top cap 40 is also provided and that is removably secured to the upper end of the tube. Furthermore, a hole 42 is formed on the upper end of the tube at a location just below the secured top cap.

A twelve-foot length of conventional and sheathed 50-ohm coaxial cable 50 is included. The cable has an upper stripped end 51 with a pair of separate bare metallic leads 52 extending therefrom. The cable also has a lower end 53 with a F-type coaxial connector 54 secured thereto. An intermediate portion 56 is extended between the ends 51, 53 and through the bore 22 of the bottom cap. The bore is backfit with a grommet 58 to thereby provide an environmental seal around the cable and thus preclude debris or water from entering the coupler.

The present invention also includes a section of linear and generally flat ribbon-type twin-lead plastic sheathed 300-ohm transmission line 60, commonly referred to as twinex transmission line. The transmission line has two parallel and metallic leads separated by a plastic portion. The transmission line has a central axis, a free end 62 with a central bore 64 formed on the plastic portion at a location between the leads, and a lower end with the bare metallic leads 66 extended therefrom. The leads at the lower end are interconnected at a junction 68. Each metallic lead on the transmission line is exposed at an intermediate location 70 that is located between the ends 62, 66. Each metallic lead of the transmission line is connected with one of the bare leads 52 of the coaxial cable at this location. In addition, a rectangular notch 80 is formed on an upper extent of the transmission line 60 at a location between the intermediate location 70 and the upper end 62 to thereby divide one of the leads into two different pieces 82, 84, and thus create an expedient J-pole antenna 86. The antenna has a short leg 88, a long leg 90, and an impedance matching stub portion 92 therebetween. The stub portion 92 has a characteristic axial length that is defined with respect to the central axis of the transmission line. The antenna is formed to transmit radio signals at frequencies that are a function of the length of the legs and the stub portion.

A loop 100 of line is disposed through the hole 42 of the tube and the bore on the transmission line 64. The loop is used for coupling the antenna 86 to the tube 30. In addition the loop allows the tube to be hung from a recipient object 112. Preferably, a nylon-type fishing line is used to form the loop.

To support the antenna, a telescopic pole 120 is included. The pole is formed of four interconnected longitudinal tubular sections 122. Each section is formed of a rigid plastic. The pole has a free lower end 124 and an upper end 126. The upper end 126 is removably frictionally secured within the lower end 16 of the coupler. The pole is extendable and retractable for allowing the elevation of the antenna 86 to be adjusted. Lastly, a coupling mechanism 130 is used for securing the lower end 124 of the pole to a recipient object. The coupling mechanism includes metal brackets 132 and associated bolts 134. The brackets and bolts in combination are used to secure the pole to a fixed object such as a wall 136.

The following table summarizes the preferred dimensions that can be set in order to achieve a structure with a desired transmission effect:

VARIOUS PROTECTED ANTENNA APPARATUS DIMENSIONS

| TUBE LENGTH (in.) | TUBE DIA. (in.) | LONG LEG LENGTH (in.) | SHORT LEG LENGTH (in.) | NOTCH LENGTH (in.) | STUB PORTION LENGTH (in.) | FREQ. (MHZ) |
|---|---|---|---|---|---|---|
| 60 | ¾ | 42 | 10 | 5½ | 1½ | VHF |
| | | 13¾ | 3¼ | 2 | | UHF |
| | | 55 | 12½ | 8¾ | | 144.0–148, 156–157.445 |
| | | 56½ | 13¼ | 7⅞ | | 144.0–148.0 |
| | | 56⅛ | 13¼ | 7⅞ | | 144.0–148, 440–450 |
| | | 82 | 19¾ | 11½ | | 88–108 |
| 168 | 1¼ | 158¼ | 37 | 21¾ | 4¼ | 50–54 |
| 300 | | 292⅔ | 68⅔ | 40⅛ | 7¾ | 28.300–28.500 |
| 312 | | 305 | 71½ | 41¾ | 8 | 26.9–27.4 |

The present invention is a new design for antennas which offers a compact, weather-protected installation. The present invention consists of ½ wavelength radiators that are fed by a ¼ wave-matching stub portion. The antenna exhibits an omni-directional pattern with little high angle radiation.

The open-stub feed J-pole antenna can be connected directly to a low impedance coaxial line. The radio frequency signal input from the cable travels down the line to the impedance matching stub. The energy is then radiated up and out of the ½ wavelength radiator.

The unique construction of using the 300-ohm twin-lead inside the length of ¾" tube causes a no-miss match to the 50-ohm coaxial feed line. The 300-ohm twin-lead is used as a convenient and field-expedient pair of wires; its resistance has little bearing upon the workings of the antenna. The ½ wave over ¼ wave construction results in an approximate 8 dB gain. In all instances, the antenna of the present invention can also receive radio signals with the frequencies as previously set forth.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A protected antenna apparatus for transmitting radio signals at characteristic frequencies comprising, in combination:

a rigid plastic and T-shaped tubular coupler having an open upper end, an open lower end, a lateral and open intermediate end, and a rigid plastic bottom cap with a circular axial bore disposed thereon and with the bottom cap removably secured over the intermediate end of the coupler;

a straight rigid elongated plastic tube of a circular cross-section, the tube having a central axis, an open upper end, an open lower end, an exterior surface, and a smooth interior surface, and with the lower end of the tube slidably removably secured within the upper end of the coupler, and with the upper end of the tube further having a rigid plastic top cap removably secured thereto and a hole formed therethrough at a location below the top cap;

a sheathed 50-ohm coaxial cable having an upper end with a pair of separate bare leads extending therefrom, a lower end with a coaxial connector secured thereto, and an intermediate portion extended between the ends and through the bore of the bottom cap;

a linear and generally flat ribbon-type twin-lead sheathed 300 ohm transmission line having a central axis, a free upper end with a central bore formed thereon between the leads, a lower end with the bare leads extending therefrom and interconnected together, an intermediate location therebetween wherein each lead is connected with one of the bare leads of the coaxial cable, and a notch formed on an upper extent of the line at a location between the intermediate location and the upper end to thereby divide one of the leads into two different pieces, and thus create a J-pole antenna having a short leg, a long leg, and an impedance matching stub portion therebetween, wherein the stub portion has a characteristic axial length as defined with respect to the central axis of the transmission line, and wherein the antenna transmits radio signals as a function of the lengths of the legs and the stub portion;

a loop of line disposed through the hole of the tube and the bore on the transmission line for coupling the antenna to the tube and for further allowing the tube to be hung from a recipient object;

a telescopic pole formed of a plurality of longitudinally connected tubular sections, the pole having a free lower end and an upper end that is removably secured with the lower end of the coupler, and with the pole being extendable and retractable for allowing the elevation of the antenna to be adjusted; and coupling means for securing the lower end of the pole to a recipient object.

2. A protected antenna apparatus comprising:

an elongated tube;

a sheathed cable having a upper end with a pair of separate bare leads extending therefrom, a lower end, and an intermediate portion extended between the ends;

a twin-lead transmission line having a central axis, a free upper end, a lower end with the bare leads extending therefrom and interconnected together, an intermediate location therebetween wherein each lead is connected with one of the bare leads of the coaxial cable, and a notch formed on an upper extent of the line at a location between the intermediate location and the upper end to thereby divide one of the leads into two different pieces, and thus create a J-pole antenna having a short leg, a long leg, and an impedance matching stub portion therebetween, wherein the stub portion has a characteristic axial length as defined with respect to the central axis of the transmission line, and wherein the antenna transmits radio signals of a characteristic frequency as a function of the lengths of the legs and the stub portion; and coupling means for securing the antenna along a longitudinal extent of the tube.

3. The protected antenna apparatus as set forth in claim 2 and further comprising:

a loop of line coupled to an upper extent of the tube for allowing it to be hung from a recipient object.

4. The protected antenna apparatus as set forth in claim 2 and further comprising:

a telescopic pole coupled to the tube allowing the elevation of the antenna to be adjusted; and coupling means for securing the pole to a recipient object.

5. The protected antenna apparatus as set forth in claim 2 wherein the tube has a length of about 5 feet and an inner diameter of about ¾ inches, the long leg of the antenna has a length of about 42 inches, the short leg of the antenna has a length of about 10 inches, the notch on the antenna has a length of about 5½ inches.

6. The protected antenna apparatus as set forth in claim 2 wherein the tube has a length of about 5 feet and an inner diameter of about ¾ inches, the long leg of the antenna has a length of about 13¾ inches, the short leg of the antenna has a length of about 3¼ inches, the notch on the antenna has a length of about 2 inches, and the stub portion has a length of about 1½ inches.

7. The protected antenna apparatus as set forth in claim 2 wherein the tube has a length of about 5 feet and an inner diameter of about ¾ inches, the long leg of the antenna has a length of about 56⅛ inches, the short leg of the antenna has a length of about 13¼ inches, the notch on the antenna has a length of about 7⅞ inches, and the stub portion has a length of about 1½ inches.

8. The protected antenna apparatus as set forth in claim 2 wherein the tube has a length of about 5 feet and an inner diameter of about ¾ inches, the long leg of the antenna has a length of about 56½ inches, the short leg of the antenna has a length of about 13¼ inches, the notch on the antenna has a length of about 7⅞ inches.

9. The protected antenna apparatus as set forth in claim 2 wherein the tube has a length of about 5 feet and an inner diameter of about ¾ inches, the long leg of the antenna has a length of about 55 inches, the short leg of the antenna has a length of about 12½ inches, the notch on the antenna has a length of about 8¾ inches, and the stub portion has a length of about 1½ inches.

10. The protected antenna apparatus as set forth in claim 2 wherein the tube has a length of about 5 feet and an inner diameter of about ¾ inches, the long leg of the antenna has a length of about 82 inches, the short leg of the antenna has a length of about 19¾ inches, the notch on the antenna has a length of about 11½ inches.

11. The protected antenna apparatus as set forth in claim 2 wherein the tube has a length of about 14 feet and an inner diameter of about 1¼ inches, the long leg of the antenna has a length of about 158¼ inches, the short leg of the antenna has a length of about 37 inches, the notch on the antenna has a length of about 21¾ inches, and the stub portion has a length of about 4¼ inches.

12. The protected antenna apparatus as set forth in claim 2 wherein the tube has a length of about 25 feet and an inner diameter of about 1¼ inches, the long leg of the antenna has a length of about 292⅔ inches, the short leg of the antenna has a length of about 68⅔ inches, the notch on the antenna has a length of about 40⅛ inches.

13. The protected antenna apparatus as set forth in claim 2 wherein the tube has a length of about 26 feet and an inner diameter of about 1¼ inches, the long leg of the antenna has a length of about 305 inches, the short leg of the antenna has a length of about 71½ inches, the notch on the antenna has a length of about 41¾ inches.

* * * * *